US008025191B2

(12) United States Patent
Sullivan et al.

(10) Patent No.: US 8,025,191 B2
(45) Date of Patent: Sep. 27, 2011

(54) HEALTH CARE SYSTEM

(76) Inventors: Michael T Sullivan, Tampa, FL (US); Wayne J Gullick, Gulfport, FL (US)

( * ) Notice: Subject to any disclaimer, the term of this patent is extended or adjusted under 35 U.S.C. 154(b) by 788 days.

(21) Appl. No.: 12/112,230

(22) Filed: Apr. 30, 2008

(65) Prior Publication Data

US 2009/0272772 A1 Nov. 5, 2009

(51) Int. Cl.
*A47G 25/80* (2006.01)

(52) U.S. Cl. ..... 223/111

(58) Field of Classification Search ..... 223/111–119
See application file for complete search history.

(56) References Cited

U.S. PATENT DOCUMENTS 4,637,533 A 1/1987 Black
5,333,361 A * 8/1994 Schaede ..... 24/182
5,392,800 A 2/1995 Sergi
5,687,889 A 11/1997 Liden
5,924,610 A 7/1999 Willemin
5,961,012 A 10/1999 Bucher
6,328,048 B1 * 12/2001 Rivera, Sr. ..... 135/66
6,651,683 B1 11/2003 Hooks et al.
6,694,641 B1 2/2004 Gill
6,942,129 B2 9/2005 Ferraioli
7,287,675 B1 10/2007 Sullivan et al.
7,337,933 B1 3/2008 Klinberg
2004/0255995 A1 12/2004 Garett

* cited by examiner

*Primary Examiner* — Shaun R Hurley
*Assistant Examiner* — Andrew Sutton
(74) *Attorney, Agent, or Firm* — Thomas Frost

(57) ABSTRACT

The present invention relates to a health care system comprised of a sock aide, a reacher and a shoe horn. The sock aide is removably coupled to the reacher by the engagement of a T-shaped arm on outer surface of the sock aide with a sleeve disposed on one end of the reacher. The sleeves are provided on opposite sides of the reacher to allow the donning of a sock to either the left or right foot. The shoe horn is slidably mounted on the reacher.

4 Claims, 5 Drawing Sheets

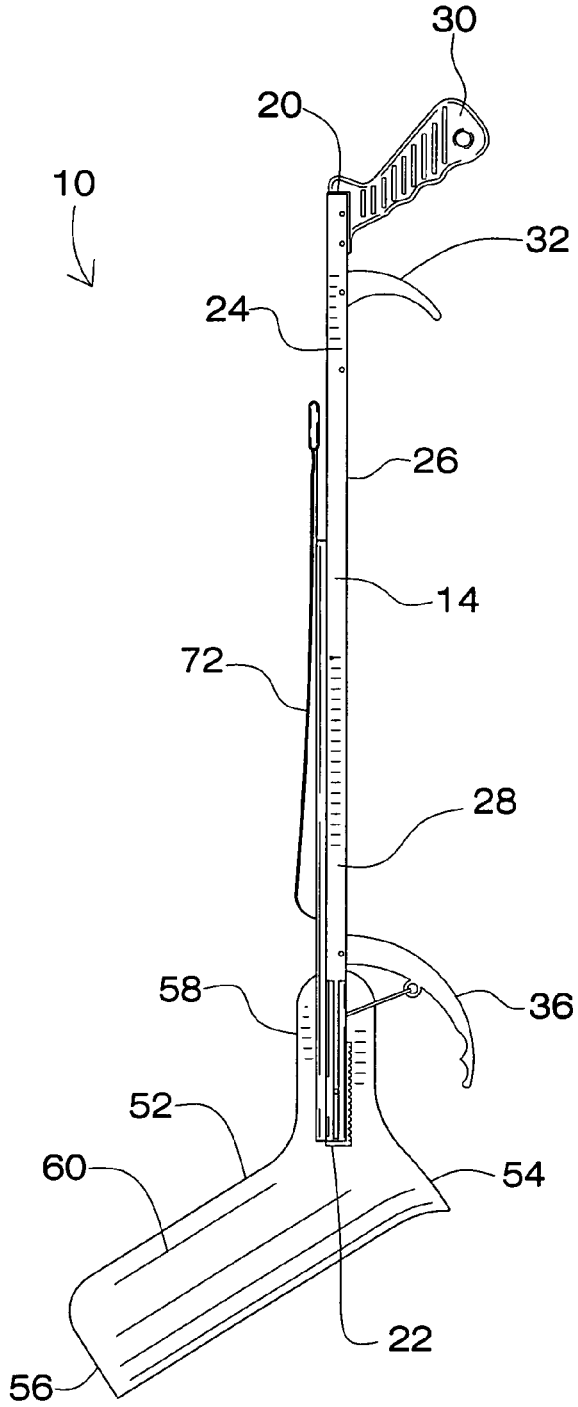
FIG. 1
FIG. 2
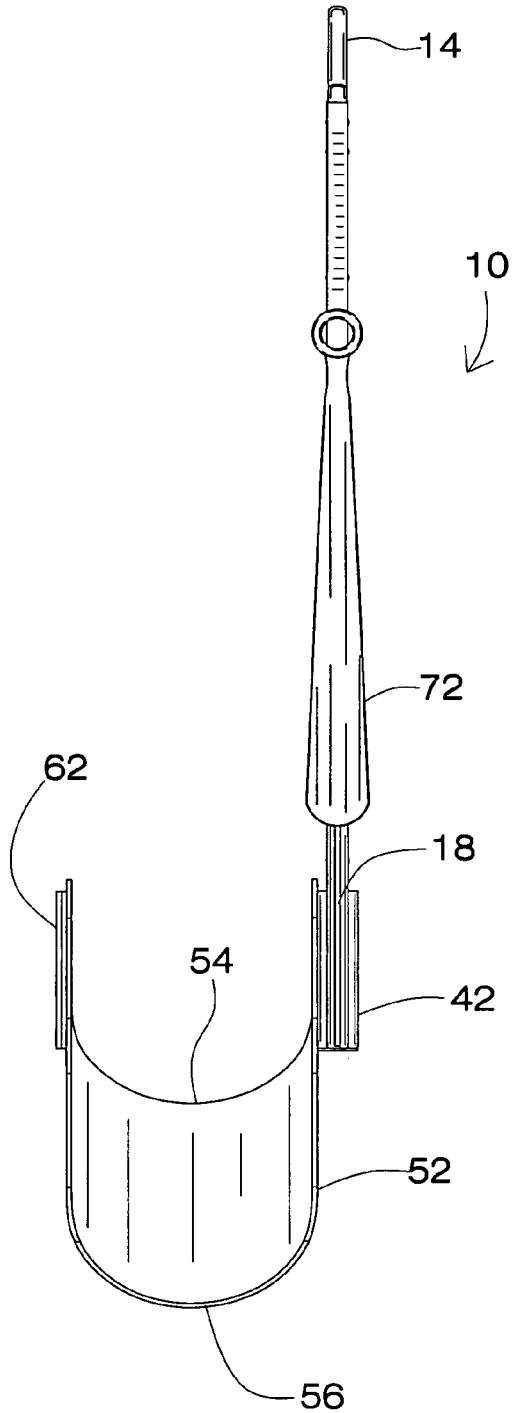

HEALTH CARE SYSTEM

BACKGROUND OF INVENTION

The present invention relates to a health care system and more particularly to assisting physically challenged people to put on shoes and socks.

Health care aides to assist physically challenged individuals to put on and remove shoes and socks are well known. U.S. Pat. No. 7,287,675, issued Oct. 30, 2007, to Sullivan et al. is incorporated herein by reference, and relates to a three-in-one health care system having a combination of a reacher, sock aide and shoe horn.

It is an object of the invention to improve upon a health care system by providing an improved sock aide with an extended portion and improved attachment means to the reacher.

SUMMARY OF THE INVENTION

The general purpose of the present invention, which will be described subsequently in greater detail, is to provide a new and improved health care system.

To attain this, the present invention comprises a reacher having a linear shaft, linear axis, proximal end and distal end. The shaft has an upper face, parallel lower face and essentially parallel side faces. A fixed handle and pivotable trigger are formed at the proximal end, the handle and the support extending from the lower face. A fixed support and a reciprocating support extend from the lower face of the distal end. A flexible line connecting the trigger and the reciprocating support allows an individual to grasp socks and the like.

A pair of sleeves is disposed on the side faces of the reacher at the distal end. One sleeve is on each side face. The sleeves have a side wall juxtaposed the side face of the reacher, a top wall and a bottom wall. Opposed edges form a space between the top wall and bottom wall.

A sock aide is provided. The sock aide has an interior and an exterior surface, and is preferably formed of rigid plastic material. The sock aide has an upper surface and a lower surface, with opposed flanges extending longitudinally from the upper end. A T-shaped arm is formed on the outer surface of each flange of the sock aide. The T-shaped arm is dimensioned to mate with the sleeve of the reacher. The user of the invention can thus switch the sock aide as needed for the left or right foot.

A shoe horn, fabricated of essentially rigid plastic material is provided. The shoe horn is mountable on the upper face of the reacher. The axis of the shoe horn is parallel with the axis of the reacher, and is movable along the axis of the reacher during operation and use.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the present invention.

FIG. 2 is a top plan view of the present invention.

DETAILED DESCRIPTION OF THE INVENTION

Figure 3:
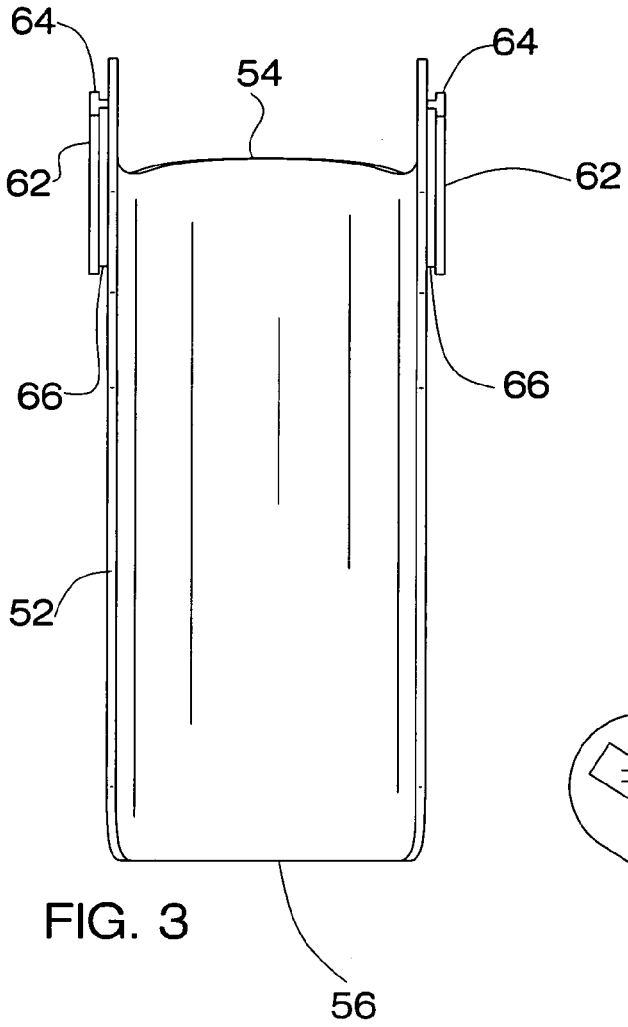
FIG. 3 is top plan view of the sock aide of the present invention.
Figure 4:
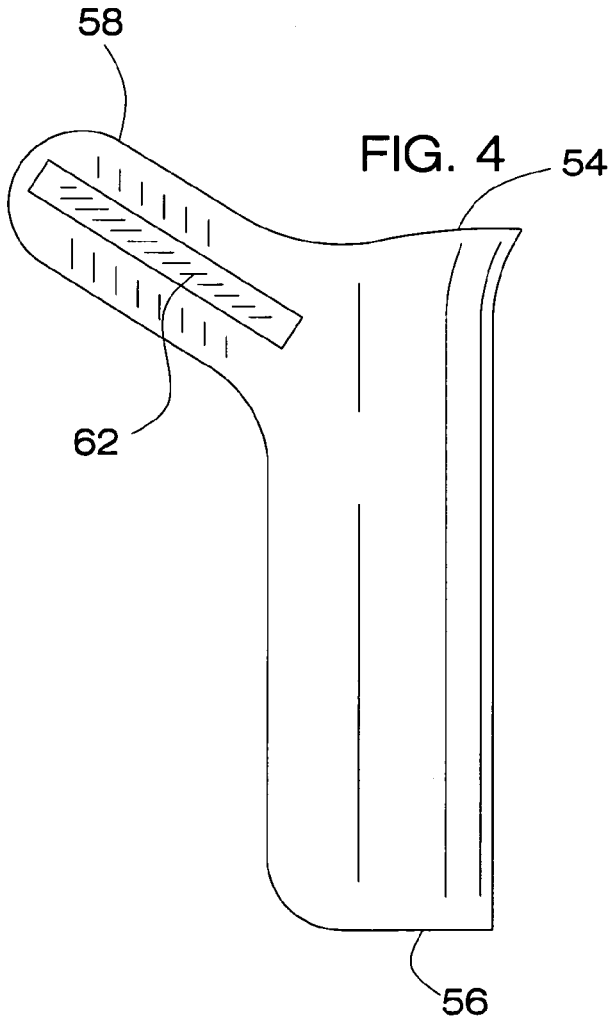
FIG. 4 is a side elevational view of the sock aide.
Figure 5:
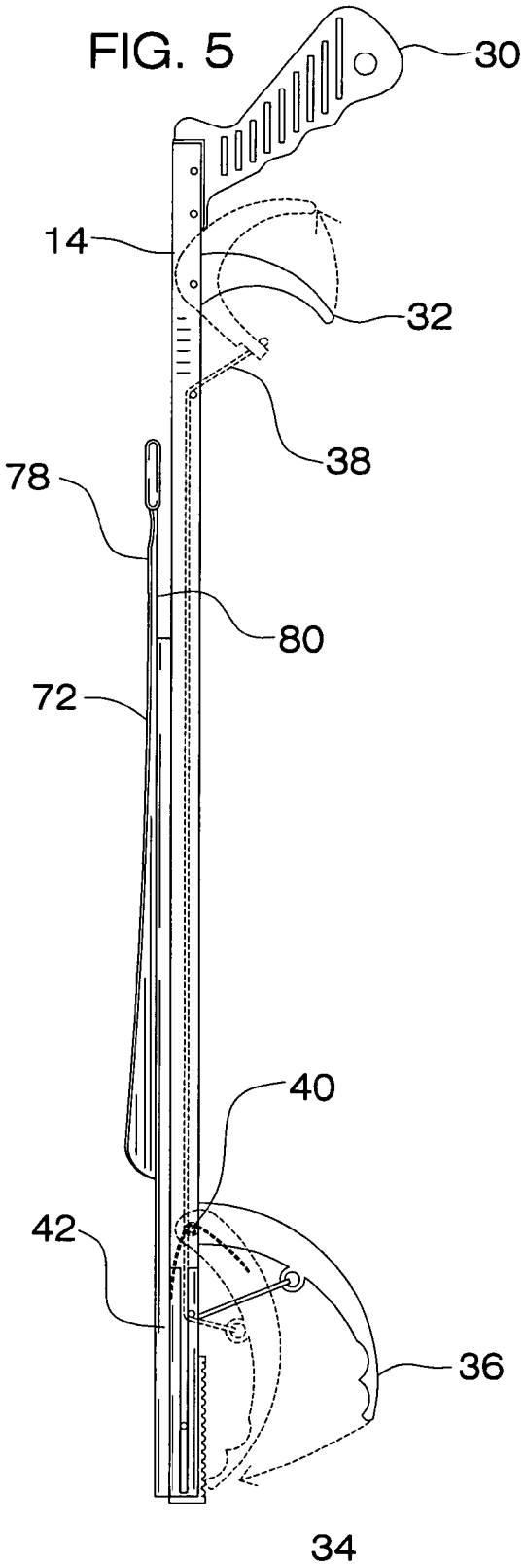
FIG. 5 is a side elevational view of the reacher of the present invention.
Figure 6:
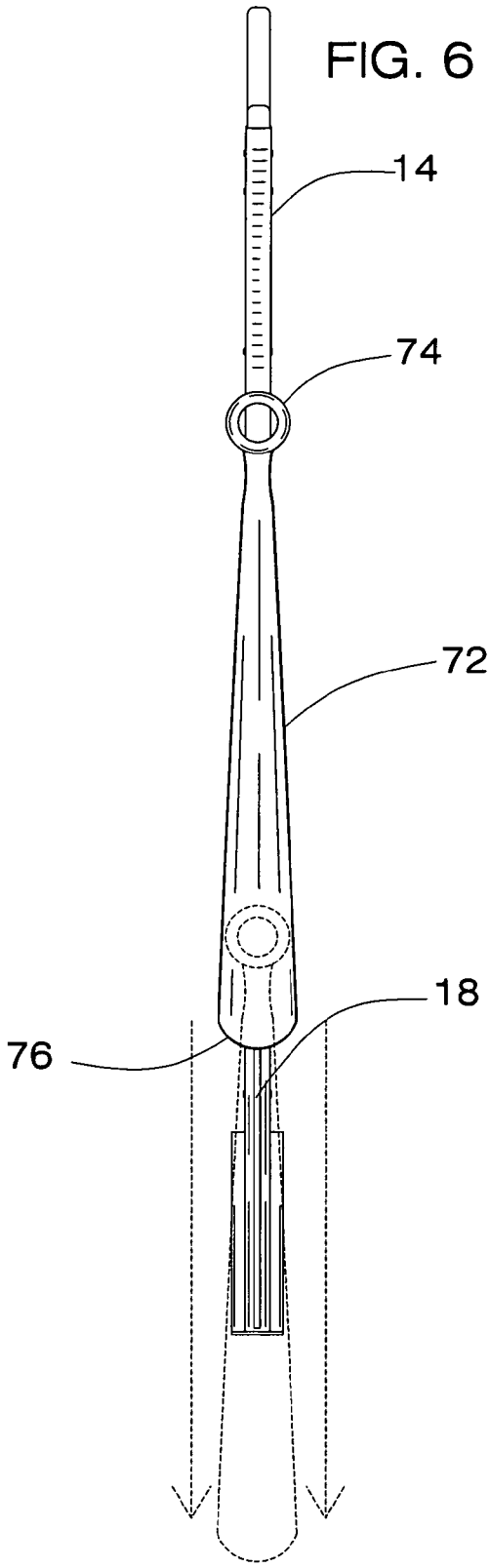
FIG. 6 is a top elevational view of the reacher.

Referring to the drawings in general and FIG. 1 in particular, an embodiment of the present invention 10 will now be described in greater detail. A reacher 14 is comprised of a linear shaft having a linear axis with a proximal end 20 and a distal end 22, the shaft having an upper face 24 and an essentially parallel lower face 26 with parallel side faces 28 there between. An elongated channel 18 is formed in the upper face 24. A fixed handle 30 and a pivotable trigger 32 extending from the lower face 26 are formed at the proximal end 20. The distal end 22 is formed with a fixed support 34 and a reciprocating support 36 extending from the lower face 26. The fixed and reciprocable supports 34, 36 have elastomeric ends for grasping socks and like objects. A flexible line 38 with a spring 40 coupling the trigger 32 and the reciprocating support 36 resiliently urge the supports apart away from a gripping relationship whereby pulling the trigger 32 rearwardly toward the handle 30 will retract the line 38 and move the reciprocating support 36 toward the fixed support 34. The fixed support 34 and reciprocable support 36 are adapted to be moved together to grip and raise socks by pulling the trigger 32 and to be moved apart to release socks by releasing the trigger 32.

Figures 9, 10:
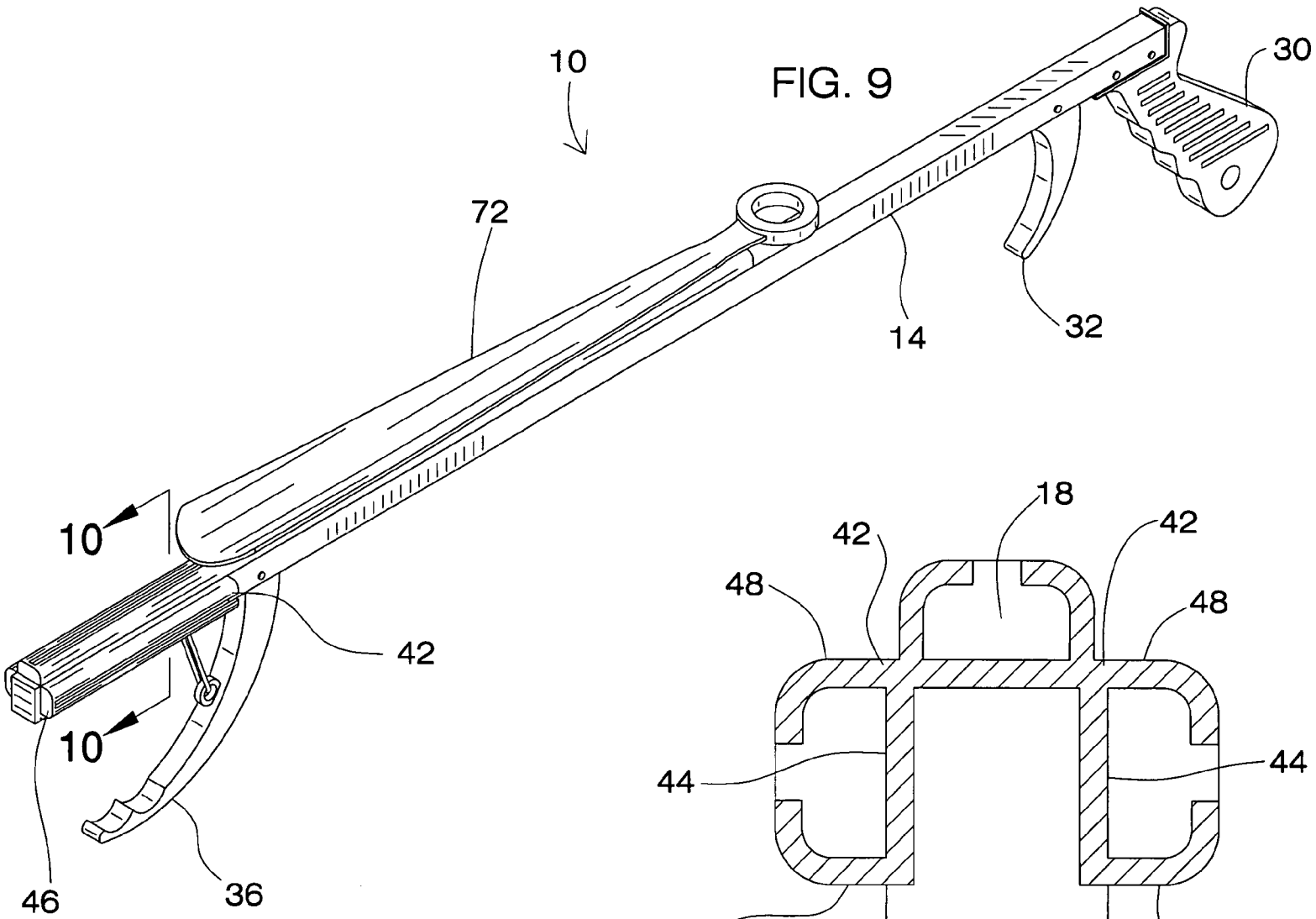
FIG. 9 is a perspective view of the invention with the sock aide disconnected from the reacher.
FIG. 10 is a cross sectional view taken along line 10-10 of FIG. 9.

As more particularly illustrated in FIGS. 9 and 10, a pair of sleeves 42 is disposed on opposed side faces 28 juxtaposed the distal end 22 of the reacher 14. Each sleeve 42 has a side wall 44, a top wall 48, a bottom wall 50 and an end wall 46 defining a cavity there between. The top wall 48 and the bottom wall 50 having opposed edges forming a space between the edges.

A shoe aide 52 to be removably coupled to the sleeve 42 is provided. The sock aide 52 has a semi-cylindrical configuration with an upper end 54 and a lower end 56, with an interior surface and an exterior surface. Opposed flanges 58 extending longitudinally from the upper end 54 are formed. T-shaped arms 62, each with a head 64 and a shaft 66, extend outwardly from the outer surface of the opposed flanges 58. The arms 62 are dimensioned to mate with the sleeves 42 during operation and use of the invention 10.

Optionally provided is a shoe horn 72. The shoe horn has an upper surface 78 and a lower surface 80, with a first end 74 and a second end 76. The shoe horn 72 is fabricated of essentially rigid plastic material and is arcuately shaped in cross sectional view. The shoe horn 72 is slidably mounted on the upper face of the reacher 14, preferably within the elongated channel 18. The axis of the shoe horn 72 is parallel with the axis of the reacher 14.

Figure 8:
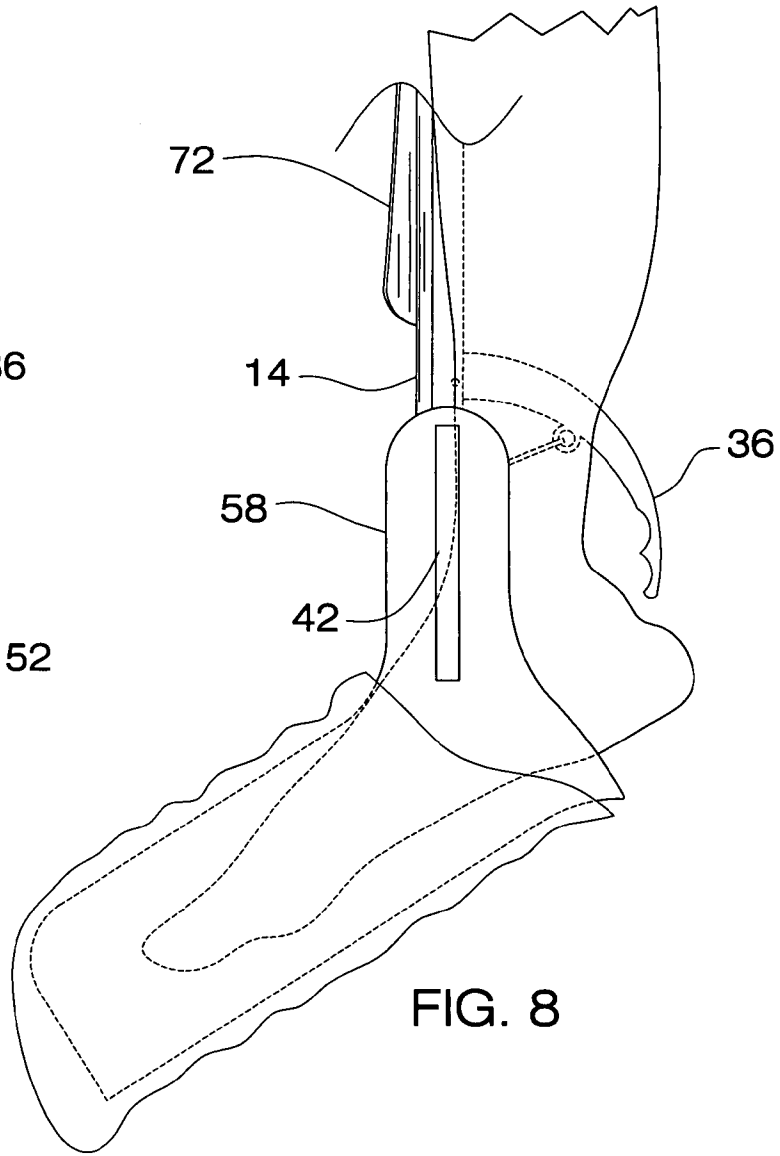
FIG. 8 is a side elevational view of the sock aide and reacher in use.
Figure 7:
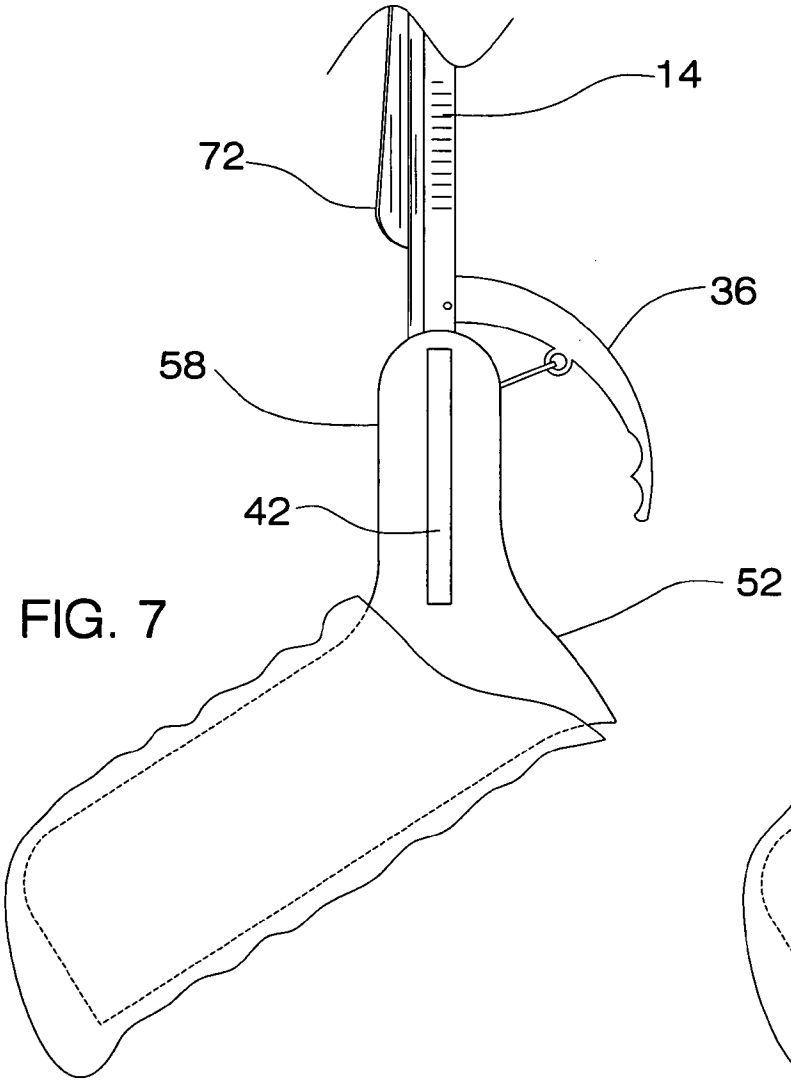
FIG. 7 is a side elevational view of the sock aide and reacher supporting a sock to be donned.

A use of the invention 10 is illustrated in FIGS. 7 and 8. An individual places a sock on the sock aide 52. The sock aide 52 is then connected with the reacher 14 by mating one T-shaped arm 62 of the sock aide 52 with the complimentary sleeve 42. The individual then places their foot on the inner surface of the sock aide 52, and pulls in an upward manner with the reacher 14. A sock is now donned on that foot. To don a sock on the other foot, the user disconnects the sock aide 52, and engages the sock aide with the sleeve 42 on the opposed side face of the reacher 14.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

We claim:

1. A health care system, comprising in combination:

a reacher having an upper face, an essentially parallel lower face with parallel side faces there between, a proximal end formed with a handle and a distal end;

a pair of sleeves disposed on the side faces juxtaposed the distal end of the reacher, one of the pair of sleeves disposed on one of the side faces and the other sleeve disposed on the opposed side face;

a sock aide removably coupled to the sleeves adjacent the distal end, the sock aide having a semi-cylindrical configuration with an upper end and a lower end, interior surface and exterior surface, a pair of opposed flanges extending longitudinally from the upper end, and a pair of T-shaped arms, each with a head and a shaft extending outwardly from the outer surface of the opposed flanges, the arms being dimensioned to mate with the sleeves during operation and use; and a shoe horn having an upper surface and a lower surface, being slidably mounted on the upper face of the reacher, the shoe horn having an arcuate cross sectional configuration with a first end adjacent to the proximal end of the reacher and a second end adjacent to the distal end of the reacher, and the shoe horn having a length less than the length of the reacher and an axis parallel with the axis of the reacher.

2. The system as set forth in claim 1, whereby the sleeves have a side wall, top wall, bottom wall and an end wall defining a cavity there between, the top walls and the bottom walls having an opposed edges forming a space between the edges to allow the shaft of the T-shaped arms to slidably engage with the sleeves during operation and use.

3. A health care system, comprising in combination:

a reacher having a linear shaft, the linear shaft having a linear axis with a proximal end and a distal end, the shaft having an upper face and an essentially parallel lower face with parallel side faces there between, an elongated channel formed in the upper face, the proximal end being formed with a fixed handle and a pivotable trigger extending from the lower face, the distal end being formed with a fixed support and a reciprocating support extending from the lower face, the fixed support and reciprocable support having elastomeric ends for grasping socks and like objects, a flexible line with a spring coupling the trigger and the reciprocating support resiliently urging the supports apart away from a gripping relationship whereby pulling the trigger rearwardly toward the handle will retract the line and move the reciprocating support toward the fixed support, whereby the fixed and reciprocable supports are adapted to be moved together to grip and raise socks by pulling the trigger and to be moved apart to release socks by releasing the trigger;

a pair of sleeves disposed from opposing side faces of the shaft spaced along the axis and positioned adjacent to the distal end of the receiver, one of the pair of sleeves disposed on one of the side faces and the other sleeve disposed on the opposed side face, the sleeves having a side wall, a top wall, a bottom wall and an end wall defining a cavity there between, the top walls and the bottom walls having opposed edges forming a space between the edges;

a sock aide removably coupled to the sleeves adjacent the distal end, the sock aide fabricated of essentially rigid plastic material in a semi-cylindrical configuration with an upper end and a lower end, interior surface and exterior surface, a pair of opposed flanges extending longitudinally from the upper end, an outwardly flared edge at the upper end, and a pair of T-shaped arms, each with a head and a shaft extending outwardly from the outer surface of the opposed flanges, the arms being dimensioned to mate with the sleeves during operation and use;

a shoe horn having an upper surface and a lower surface, being slidably mounted within the elongated slot on the upper face of the reacher, the shoe horn having an arcuate cross sectional configuration with a first end adjacent to the proximal end of the reacher and a second end adjacent to the distal end of the reacher, and the shoe horn having a length less than the length of the reacher and an axis parallel with the axis of the reacher.

4. A health care system for assisting physically challenged individuals to put on socks, comprising in combination:

a reacher having an upper face, an essentially lower face with parallel side faces there between, a proximal end being formed with a handle and a distal end, with a pair of sleeves disposed upon the opposing side faces juxtaposed the distal end of the reacher; and a sock aide removably coupled to the sleeves adjacent the distal end, the sock aide fabricated of essentially rigid plastic material in a semi-cylindrical configuration with an upper end and a lower end, interior surface and exterior surface, opposed flanges extending longitudinally from the upper end, and a pair of T-shaped arms, each with a head and a shaft extending outwardly from the outer surface of the opposed flanges, the arms being dimensioned to mate with the sleeves during operation and use.

* * * * *